US007581974B2

(12) United States Patent
Liu et al.

(10) Patent No.: US 7,581,974 B2
(45) Date of Patent: Sep. 1, 2009

(54) ELECTRICAL CONNECTOR WITH RETAINING MEMBER

(75) Inventors: Tian-Hong Liu, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,771

(22) Filed: Dec. 27, 2007

(65) Prior Publication Data

US 2008/0160818 A1 Jul. 3, 2008

(30) Foreign Application Priority Data

Dec. 27, 2006 (CN) ..... 2006 1 0155947

(51) Int. Cl.
*H01R 12/28* (2006.01)

(52) U.S. Cl. ..... 439/260; 439/495; 439/570

(58) Field of Classification Search ..... 439/260, 439/495, 570

See application file for complete search history.

(56) References Cited

U.S. PATENT DOCUMENTS

| | | | | |
|---|---|---|---|---|
| 6,203,345 | B1 * | 3/2001 | Roque et al. | 439/260 |
| 6,254,406 | B1 | 7/2001 | Chiu et al. | |
| 6,921,274 | B2 | 7/2005 | Yu | |
| 7,291,039 | B2 * | 11/2007 | Shin | 439/495 |
| 7,357,663 | B2 * | 4/2008 | Wei et al. | 439/495 |

* cited by examiner

*Primary Examiner*—Gary F. Paumen
(74) *Attorney, Agent, or Firm*—Wei Te Chung

(57) ABSTRACT

An electrical connector (100) for connecting a sheet-like connection member includes an insulating housing (1)provided with a plurality of conductive terminals (2, 3), defining a pair of slot (15) at opposite ends thereof. A pair of retaining members (4) is embedded in the slot (15), each comprises a retaining portion (44) retained in the slot (15), a bending portion (41) and a soldering portion (42) extending from a top edge and a bottom edge thereof respectively. The bending portion (41) and the solder portion (42) extend in an adverse direction and the bending portion is abutting against a top portion of the housing.

2 Claims, 9 Drawing Sheets

ELECTRICAL CONNECTOR WITH RETAINING MEMBER

BACKGROUND OF THE INVENTION

1. Field of the invention

The present invention relates to an electrical connector, and more particular to an electrical connector for a sheet-like connection member such as a flexible printed circuit (FPC), a flexible flat cable and so forth. All of these cables and circuit hereafter will be generally referred to as "FPC" for simplification.

2. Description of Related Art

U.S. Pat. No. 6,921,274 discloses a conventional electrical connector adapted for connecting an FPC. The connector comprises a longitudinal insulating housing defining a receiving cavity with a pair of slots respectively formed at opposite ends. A plurality of terminals is mounting on the housing with solder portions extending rearward to solder on a printed circuit board (PCB). A pair of retaining members is embedded in the slot and each comprises a retaining portion retained in a back end of the slot and a solder portion extending out of the slot to be soldered on the PCB. An actuator is rotatablely mounted on the housing 1 and presses the FPC to electrically contact with the terminals.

After the connector is mounted onto the PCB, if the FPC is enforced by an unexpected upward force, the front portion of the housing may be pulled upward because the retaining member only fix the rear portion of the housing, which will destroy the connection between the terminals and the PCB. Therefore, an improved electrical connector is required to overcome the problem.

SUMMARY OF THE INVENTION

An object of the present invention is to provide an electrical connector with an improved retaining member.

In order to achieve above-mentioned objects, an electrical connector comprises an insulating housing provided with a plurality of conductive terminals, defining a pair of slots at opposite ends thereof; a pair of retaining member embedded in the slot, each comprising a retaining portion retained in the slot, a bending portion and a soldering portion extending from a top edge and a bottom edge thereof respectively; wherein the bending portion and the solder portion extend in an adverse direction and the bending portion is abutting against a top portion of the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
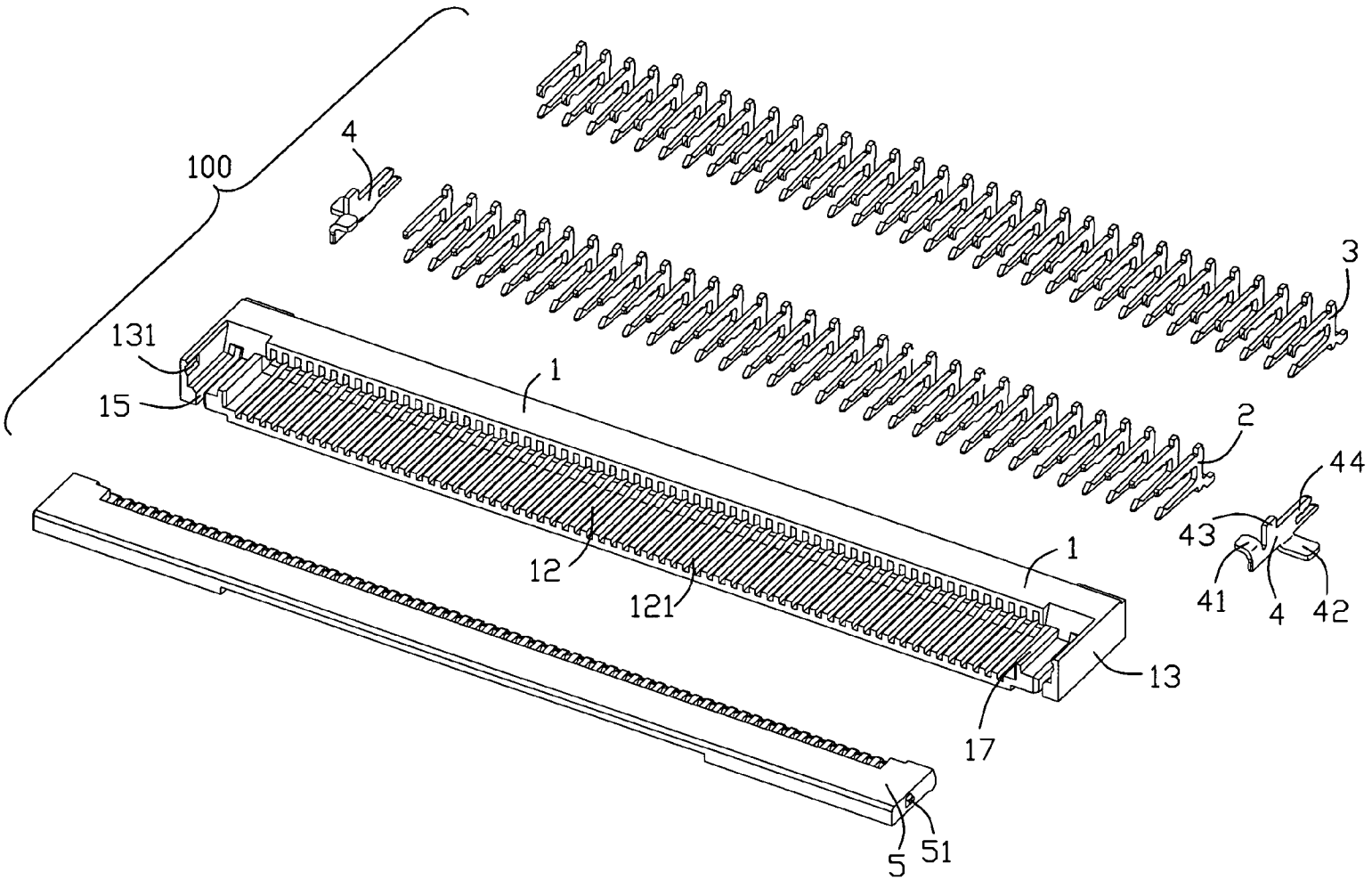
FIG. 1 is an exploded perspective view of an electrical connector in accordance with the present invention.

Reference will now be made to the drawing figures to describe the preferred embodiment of the present invention in detail.

Figure 2:
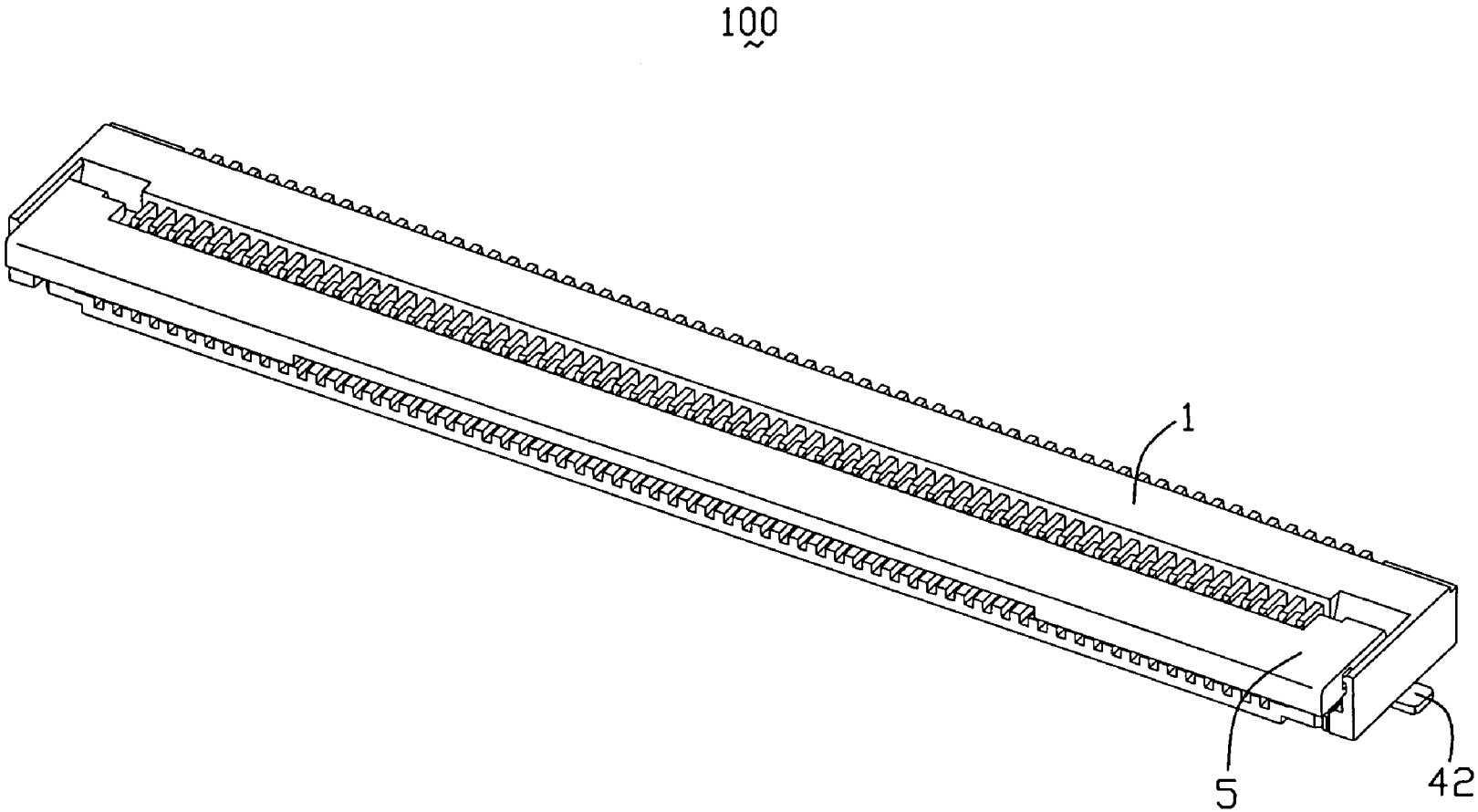
FIG. 2 is an assembled perspective view of the electrical connector.
Figure 3:
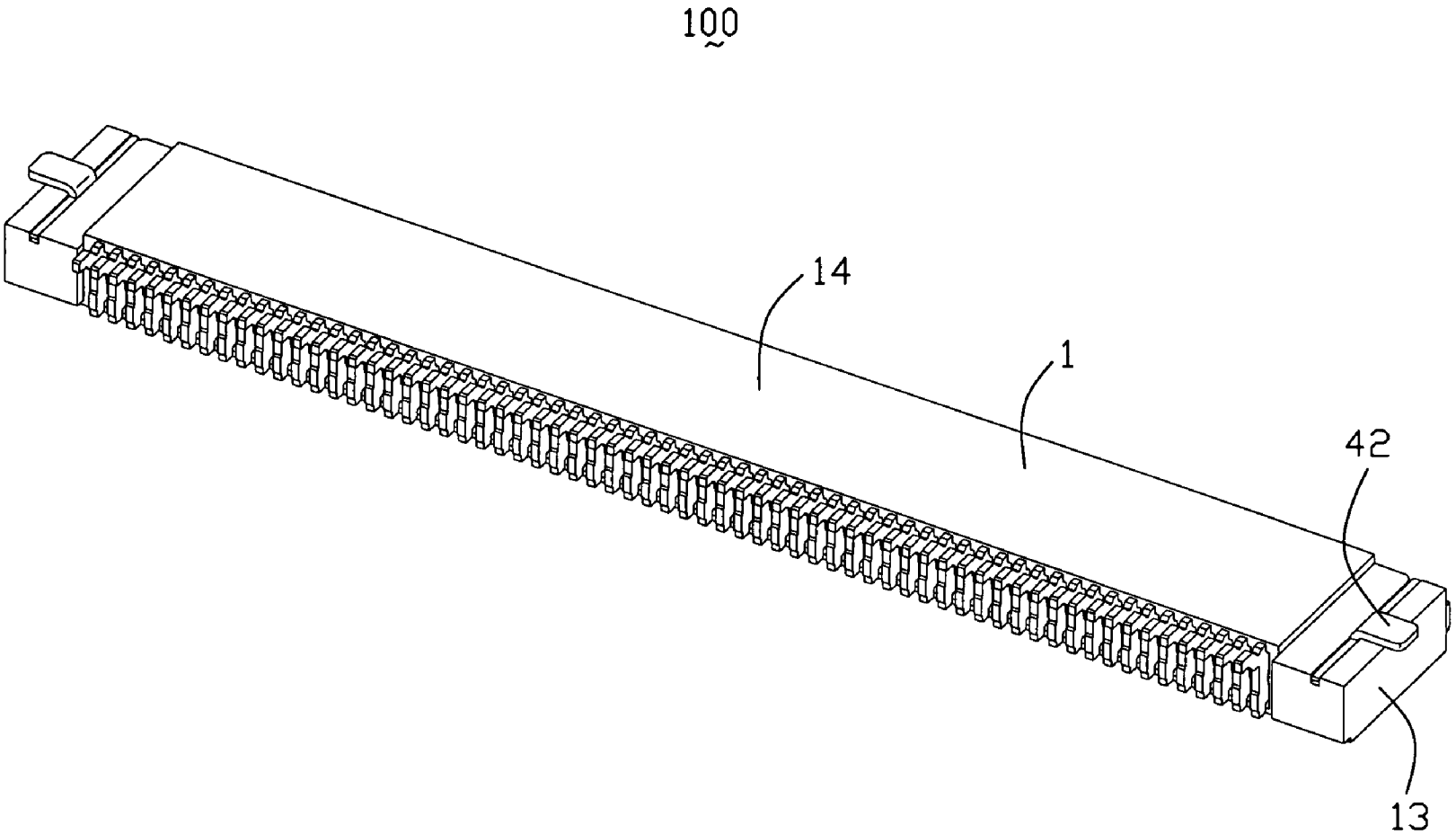
FIG. 3 is another view of the electrical connector shown in FIG. 2.

Referring to FIGS. 1 and 2, an electrical connector 100 in accordance with the present invention comprises an insulating housing 1, a plurality of first terminals 2 and second terminals 3 received in the housing 1, two retaining members 4 embedded in the housing 20 and an actuator 5 rotatablely mounted on the housing 1.

Referring to FIG. 1, the housing 1 of elongated shape defines a cavity 12 opened upward and forward at one side thereof with two opposite sidewalls 13. A pair of supporting ribs 17 respectively extends upward from the top face of the cavity 12 in a front-to-back direction (i.e. an insertion direction) to divide the cavity 12 into two parts. The middle part of the cavity is used to receive a corresponding FPC and defines a plurality of passageways 121 parallel arranged along an elongated direction perpendicularly to the front-to-back direction and running through the rear end of the housing 1. The side parts of the cavity is defined as a supporting portion and used to receive a pair of retaining member 4. A slot 15 extends from the front face to the rear face of the housing in the front-to-back direction in the supporting portion. The rear portion of the slot 15 are divided into two portions by a partition 18 unitarily formed with the housing, an upper groove 153 and a lower groove 154 parallel to the upper groove. The lower groove 154 is running through the back wall of the housing and open to the bottom of the housing.

Figure 4:
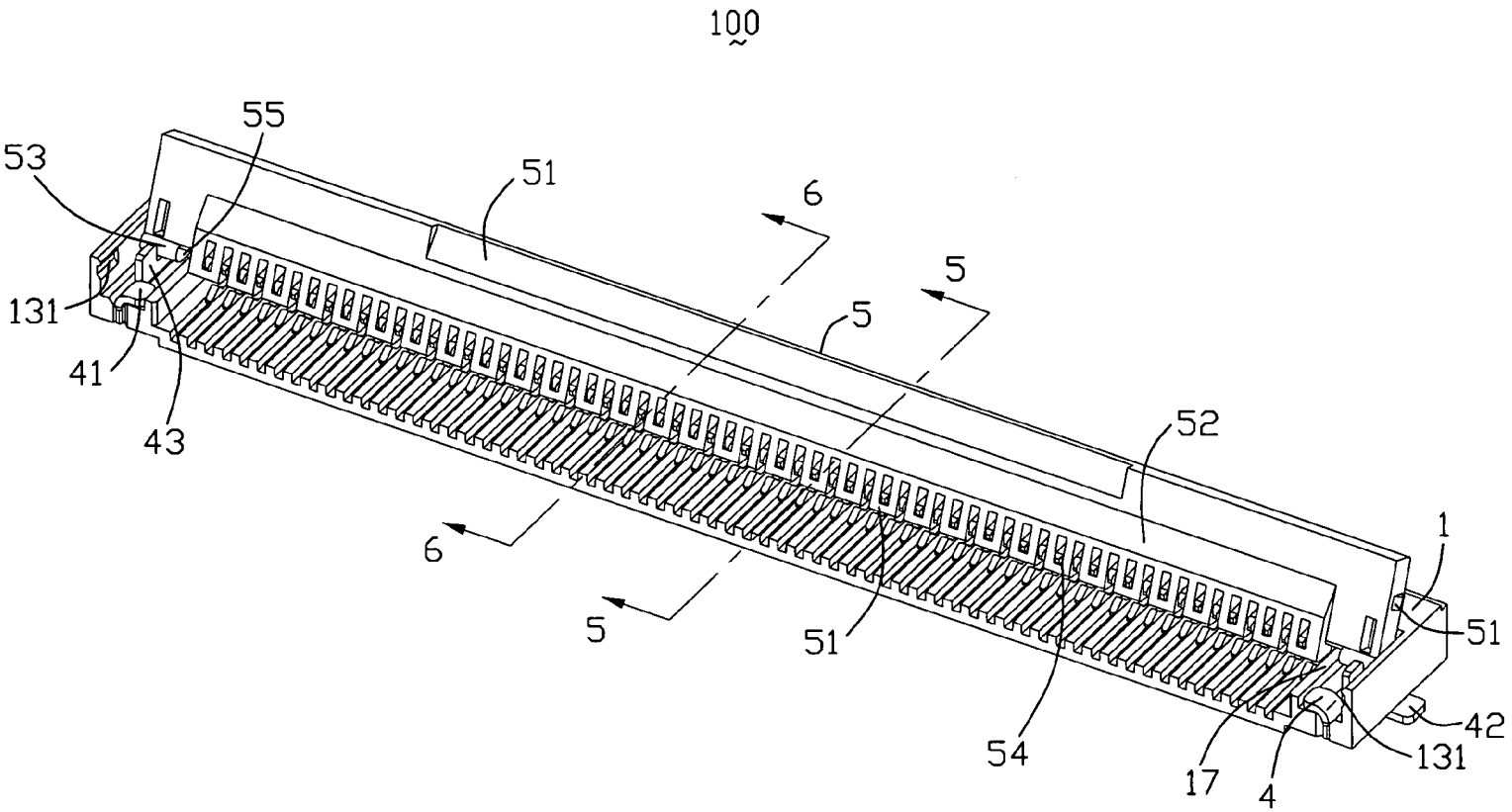
FIG. 4 is an assembled perspective view of the electrical connector wherein an actuator is in an open position.
Figure 5:
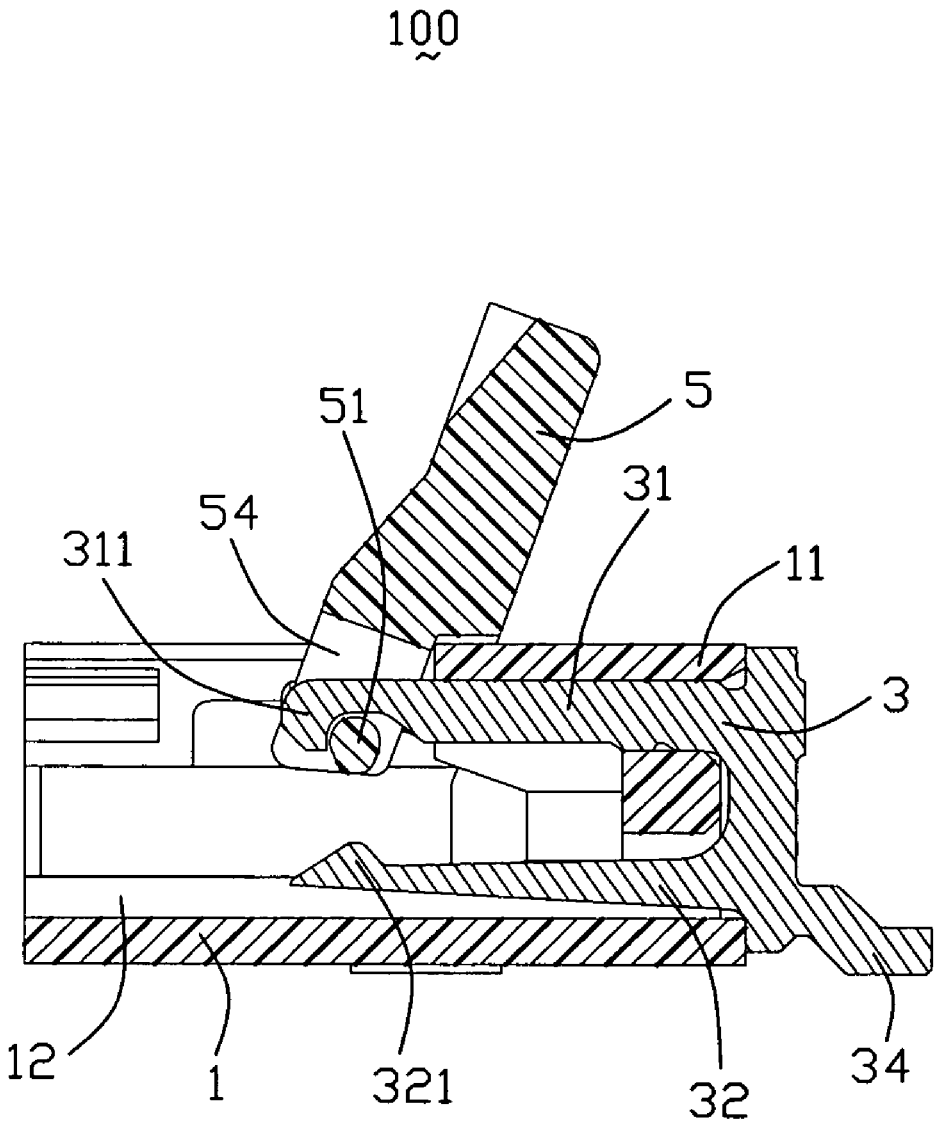
FIG. 5 is a cross-sectional view of FIG. 3 taken along line 5-5.
Figure 6:
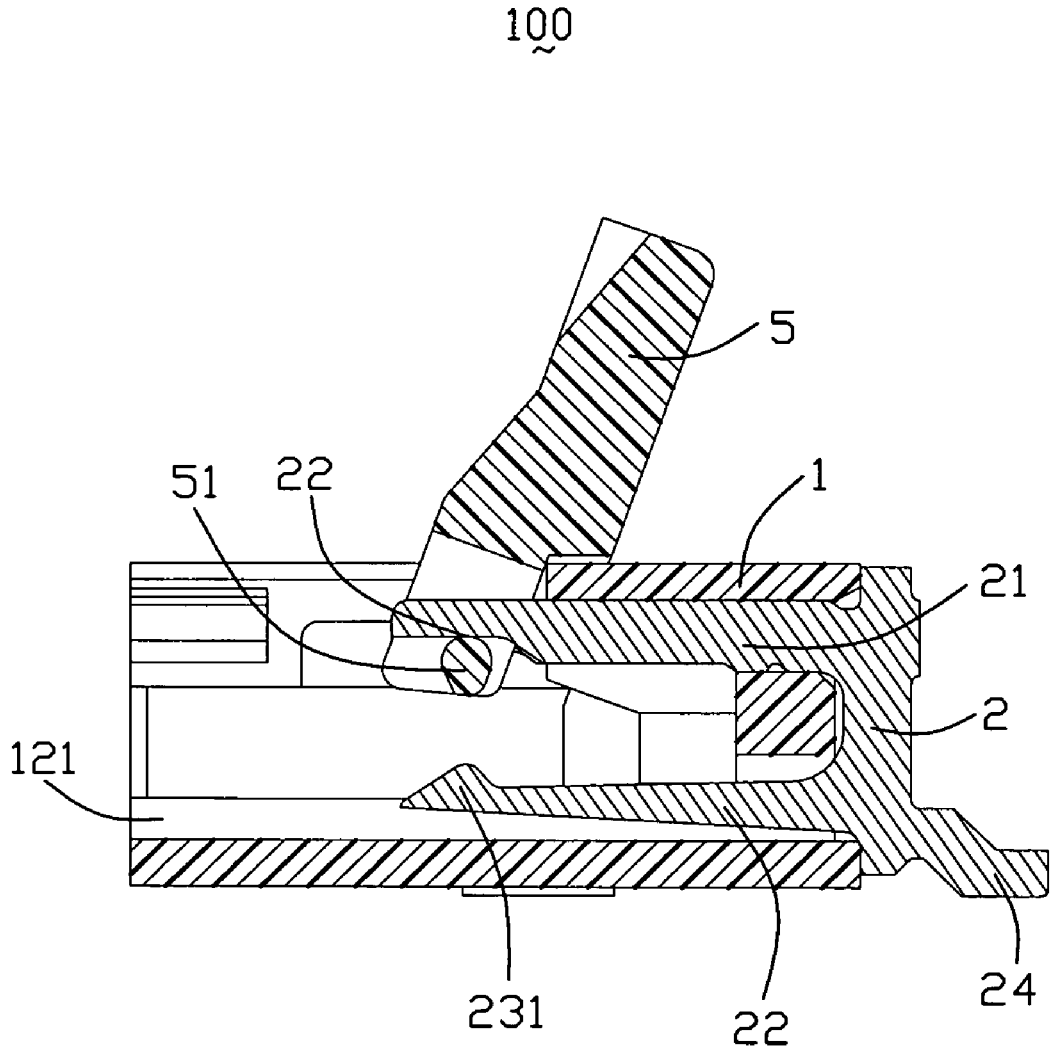
FIG. 6 is a cross-sectional view of FIG. 3 taken along line 6-6.

Referring to FIGS. 1 and 4, the first and second terminals 2, 3 are retained in the passageways 121 and the actuator 5 is assembled in the cavity 12. The actuator has a plurality of receiving holes 54 formed at one side thereof and each receiving hole is used to receive an upper arm of the terminal. See FIG. 5, each second terminal 3 comprises an upper arm 31 with a hook portion 311 facing the cavity 12, a lower arm 32 opposite the upper arm with a contacting portion 321 projecting to the cavity and a soldering portion 34 extending out of the housing. The hook portion 311 passes through the receiving hole 54 and grasps a shaft 51 in the hole so the actuator 5 can rotate along the shaft relative to the top of the cavity. See FIG. 6, the first terminal 2 is similar to the second terminal 3 with an opposite upper arm 21 and lower arm 22 and a soldering portion 24 extending out of the housing. A contacting portion 221 is formed at a distal end of the lower arm 22 facing the cavity 12. The upper arm of the first terminal has no hook portion, which is different from the second terminal 2.

Referring to FIG. 4, the actuator 5 is of elongated board and said receiving holes 54 are formed on a comb portion 52 which is disposed at one side of the actuator for urging with the FPC. A pivot portion 53 is defined at both end of the comb portion 52 and spaced away the comb portion with a groove 55 for receiving the rib 17. The pivot portion 53 is installed into the cavity between the rib 17 and the sidewall 13 upon the retaining member 4, which will be detailed described hereinafter. A pair of protrusions 57 is formed on both ends of the board respectively. When the actuator 5 is rotated to a closed position, the protrusions 57 will buckle with a receiving recess 131 formed on the upper portion of the inner sidewall 13. The work theory of the actuator 5 is common acknowledge for the people in the field, so the detail description about it is omitted.

Figure 7:
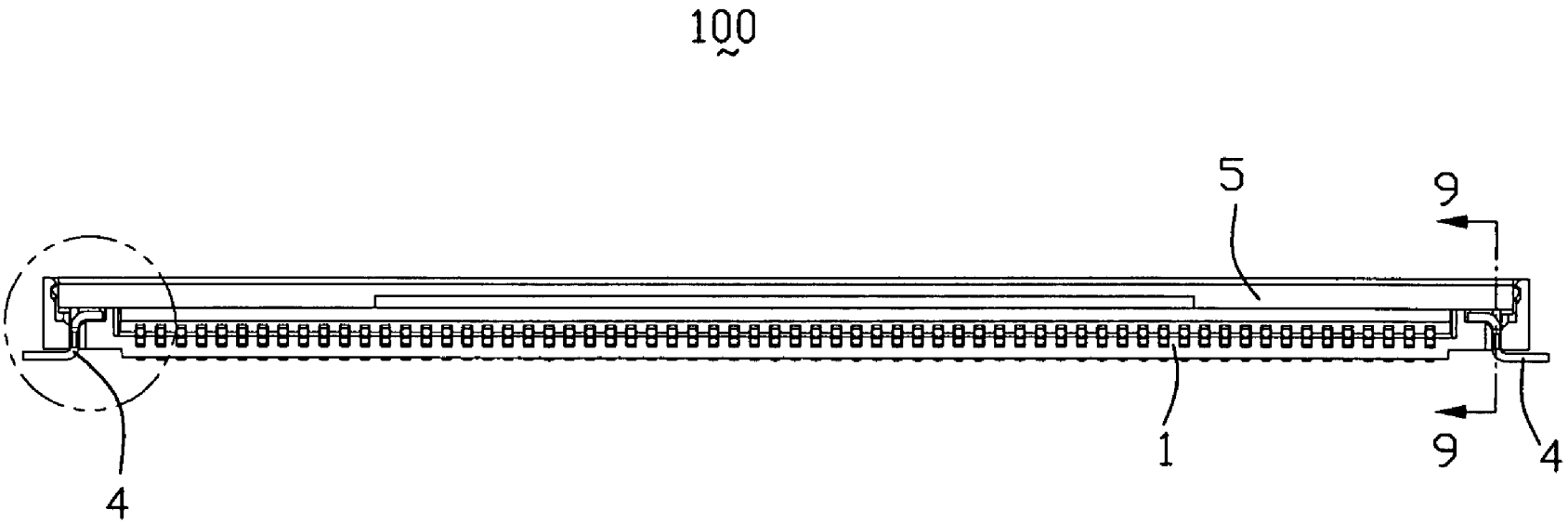
FIG. 7 is a front view of the electrical connector shown in FIG. 2.
Figure 8:
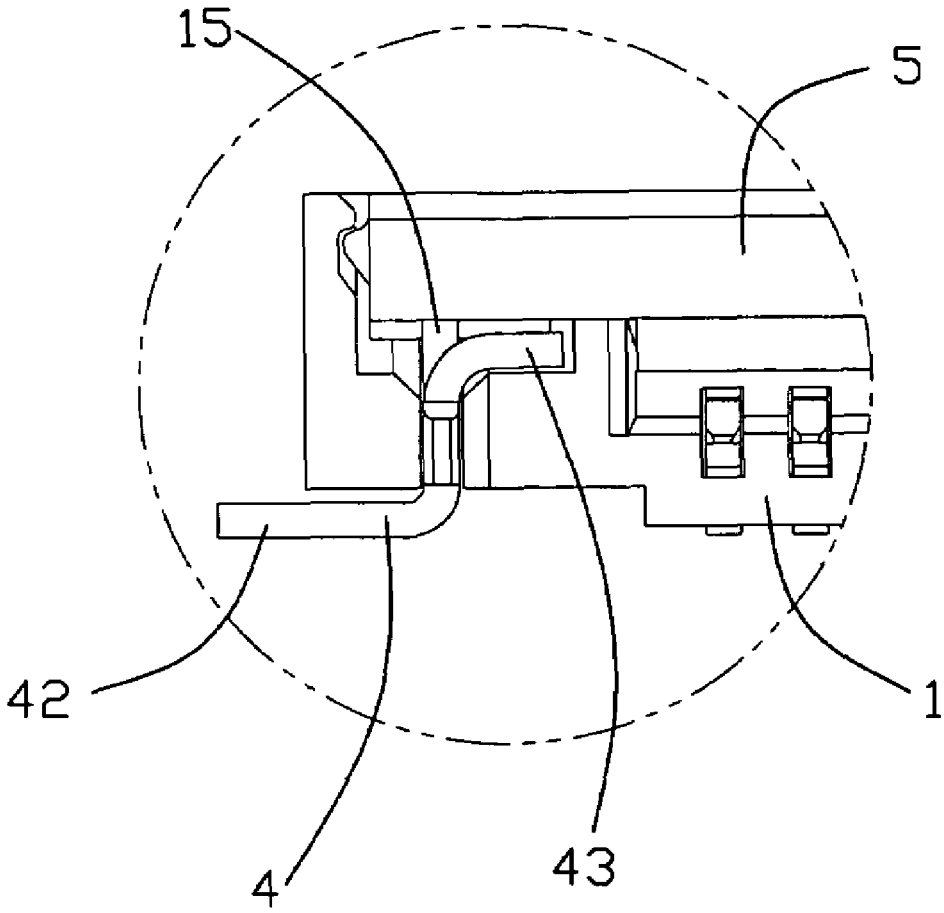
FIG. 8 is a partly-amplificatory view of the electrical connector shown in FIG. 7.
Figure 9:
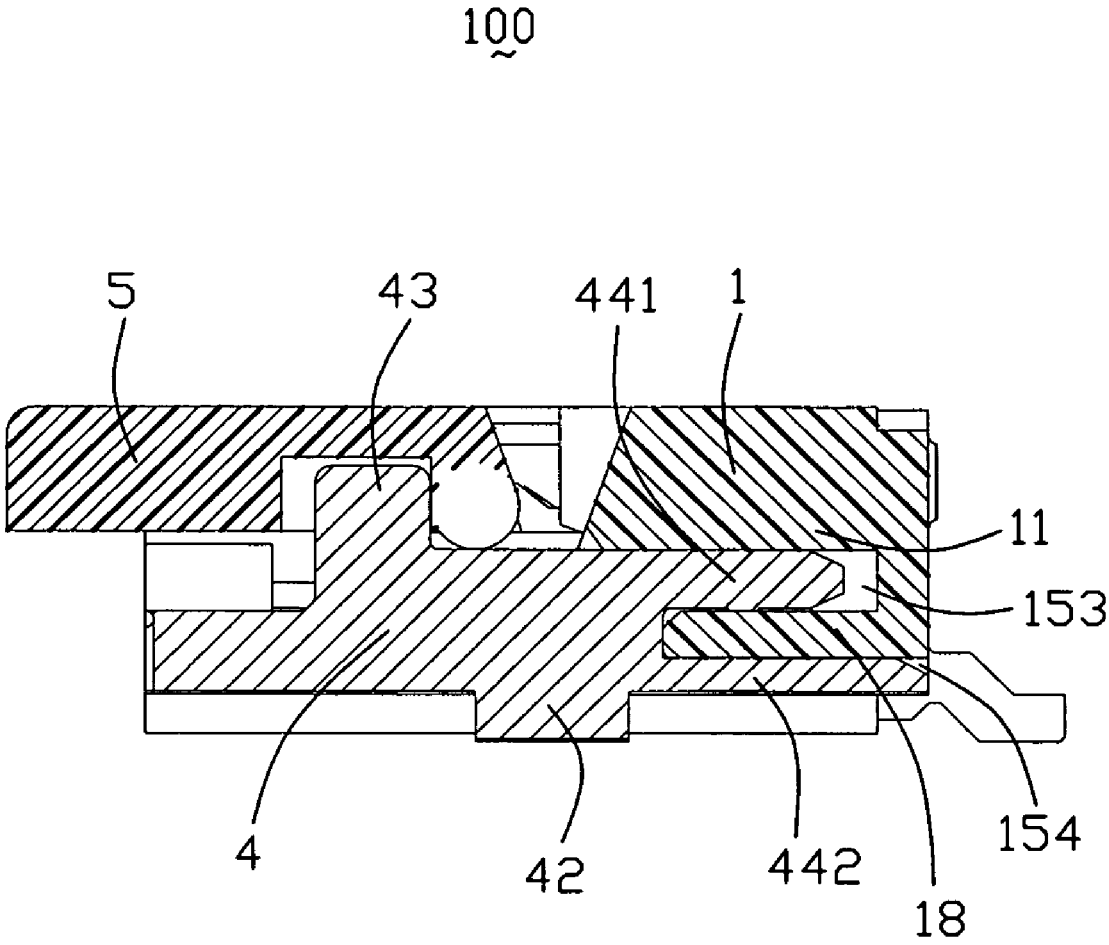
FIG. 9 is a cross-sectional view of FIG. 7 taken along line 9-9.

Referring to FIGS. 1 and 4, the retaining member 4 is made from a metal sheet and is retained in the slot 15 by the retaining portion 44. The retaining portion 44 is in a fork like shape and comprises an upper arm 441 and a lower arm 442. The upper arm 441 is retained in the upper groove 153 and the lower arm 442 is received in the lower grooves 154 and exposed to the outer of the housing. A stopping portion 43 is provided extending upward from the top edge thereof, which can prevent the pivot portion 53 of the actuator 5 from forward moving while the pivot portions are supported by the top edge of the retaining member. A bending portion 41 is bent inwardly at the front portion of the retaining member 4 and abutting against the top portion of the supporting portion. A solder portion 42 is extending outwardly at the rear portion of the retaining member 4 and along the bottom of the housing. The bending portion 41 and the solder portion 42 are extending in an adverse direction (see FIGS. 7 and 8), which can decrease exterior force exerted on the housing. The reasons will be explained hereinafter.

Referring to FIG. 4, the solder portion 42 of the retaining member 4 can fix the housing 1 on to the PCB, the bending portion 41 and the retaining portion 44 can separately secure front portion and rear portion of the housing 1. If the FPC received in the receiving cavity is pulled up by an unexpected upward force, the front portion of the housing 1 may be driven by the actuator 5 and produces an upward force, at the same time the bending portion 41 of the retaining member 4 can give a downward force onto the front portion of the housing 1 to counteract the upward force, therefore the front portion of the housing 1 could not move upward and ensure the connector mounting on the PCB.

The present invention is not limited to the electrical connector mentioned above. This disclosure is illustrative only, changes may be made in detail, especially in matter of shapes, size, and arrangement of parts within the principles of the invention.

What is claimed is:

1. An electrical connector comprising:

an insulating housing defining a receiving space;

a plurality of conductive terminals disposed in the housing with contacting sections extending into the receiving space;

an actuator pivotally movable relative to the housing to cancel or expose the receiving space between an open position and a closed position for allowing an FPC (Flexible Printed Circuit) to be efficiently engaged with the terminals;

a pair of retaining members securely disposed at two opposite longitudinal ends of the housing, each of said retaining members including a soldering portion for securing to a printed circuit board on which the housing is seated, and an upwardly extending stopping portion which extends into a corresponding recess in an underside of the actuator when said actuator is located in said closed position.

2. The electrical connector as claimed in claim 1, wherein said retaining member further includes a bending portion on which the actuator is seated when said actuator is located in the closed position.

* * * * *